United States Patent [19]

Shapiro

[11] Patent Number: 4,759,194

[45] Date of Patent: Jul. 26, 1988

[54] DECORATIVE INSULATING COVERS FOR IN WALL AIR CONDITIONERS AND FANS

[76] Inventor: Stephen S. Shapiro, 21 Danny's Way, Wallingford, Conn. 06492

[21] Appl. No.: 134,967

[22] Filed: Dec. 18, 1987

[51] Int. Cl.[4] ..... F25D 23/12

[52] U.S. Cl. ..... 62/262; 150/52 R

[58] Field of Search ..... 62/262; 150/52 R

[56] References Cited

U.S. PATENT DOCUMENTS

| | | | |
|---|---|---|---|
| 2,705,990 | 4/1955 | Miller | 62/262 X |
| 2,711,769 | 6/1955 | Katcher et al. | 62/262 X |
| 2,720,236 | 10/1955 | Hoffman | 62/262 X |
| 2,992,668 | 7/1961 | Collard | 150/52 R |
| 3,320,996 | 5/1967 | Singer | 150/52 R |
| 4,202,389 | 5/1980 | Ewald | 150/52 R |
| 4,308,905 | 1/1982 | Gallagher | 150/52 R |
| 4,325,229 | 4/1982 | DeZurik | 62/262 |
| 4,625,784 | 12/1976 | Boroson | 150/52 R |

*Primary Examiner*—Lloyd L. King

*Attorney, Agent, or Firm*—CTC & Associates

[57] ABSTRACT

The present invention relates to an insulating cover device for through wall appliances such as air conditioning and fan units. The insulating cover is of one piece construction and is designed to minimize heat losses through both the appliance and through any air gaps or wall sleeves and openings. The insulating device is designed to fit the appliance in place of the normal operating appliance cover.

3 Claims, 2 Drawing Sheets

DECORATIVE INSULATING COVERS FOR IN WALL AIR CONDITIONERS AND FANS

BACKGROUND OF THE INVENTION

Many buildings and homes that have been designed without central air conditioning utilize smaller size air conditioners or fans in individual rooms to provide cooling during warm and humid weather. These individual units are installed in windows or in through-wall sleeves or openings. In colder weather these units and their through wall openings constitute a significant heat loss path and also result in drafts. The instant invention provides an improved means for addressing these problems.

DESCRIPTION OF THE PRIOR ART

A large number of through wall air conditioning covers have been developed to minimize heat loss through the air conditioner and, where applicable, the wall sleeve and opening during cold weather. These previously developed covers are of multi-part construction in order to include both front and side walls. In addition, the way they are designed requires various combinations of fasteners and latches in order to achieve a snug fit over the air conditioning unit. In some cases, these covers require the in-house assembly of frames in order to be installed and are therefore difficult for the layman to use. Many of the previously developed covers do not extend to the interior building wall and therefore neglect a major heat loss path. In all cases, these covers are suited for generally rectangular shapes and are not easily adapted to non-rectangular shapes. These prior devices have proven to be awkward to install, are of varying effectiveness, and are unattractive.

Typical prior art devices relating to air conditioning covers are represented by the following references of interest.

| U.S. Pat. No. | Date | Inventor |
|---|---|---|
| 4,625,784 | June 12, 1985 | Boroson |
| 4,325,229 | April 20, 1982 | DeZuric |
| 4,308,905 | January 5, 1982 | Gallagher |
| 4,202,389 | May 13, 1980 | Ewald |
| 3,320,996 | May 23, 1967 | Singer |
| 2,992,668 | January 5, 1960 | Collard |

Boroson discloses a fabric cover with elasticized sides and folds to expand the depth of the cover. This device does not cover the built-in sleeve or opening which surrounds the air conditioner and therefore does not affect the entire heat loss path. The fabric construction is multi-ply and requires a sewn fabrication process.

DeZurik discloses a molded cover which fits over the air conditioning unit and includes a gasket to seal between the cover and the building wall. The DeZuric concept includes a series of brackets, fasterers, and latches to hold the cover on to the air conditioner and to compress the wall gasket. The lack of fasteners and latches is an important facet of the present invention.

Gallagher describes an open box-like rectangular cover with a series of latches and rigid members to hold the cover in place. The Gallagher cover is designed for either exterior or interior use. No provision for covering the wall opening or sleeve is provided for.

Ewald discloses an adapter frame which shapes and aligns a cover over an air conditioning unit and also holds a wall gasket in place with fastening screws. The adapter frame and gasket system requires manual assembly and is therefore awkward to install.

Singer has designed a cover for exterior central air conditioner units. The Singer concept is not applicable to wall units.

Collard discloses a two ply, heat sealed, telescoping thermoplastic air conditioner cover. This cover incorporates stiffening strips to hold the cover tightly to the air conditioner. The Collard concept is applicable to rectangular shapes and does not extend to the wall opening a sleeve as does the present invention.

SUMMARY OF THE PRESENT INVENTION

The present invention relates to a decorative insulating cover for in wall air conditioning, fan units or other applicances. This concept is also applicable to any shaped through wall opening where an insulating cover is desired. The present invention has been developed to provide a more effective, easy to install, and decorative cover for such applicances and wall sleeves or openings. This concept permits one piece construction for both regular and irregular shaped openings. The cover is easily installed as a snug fitting slip on cover that provides insulating value for the entire unit including the gap between the unit and the building wall. The cover is constructed from insulating material such as closed cell styrofoam in order to minimize the heat loss through the metal walls and cover. This insulating cover is designed to fit over the applicance, replacing the normal operating applicance cover.

DESCRIPTION OF THE FIGURES

The present invention may be better understood and its interrelated objects and advantages will become apparent to those skilled in the art by reviewing the accompanying drawings together with the description of the preferred embodiment. In these drawings, like reference numerals refer to like elements in the several figures and wherein.

DESCRIPTION OF THE PREFERRED EMBODIMENT

Figure 1:
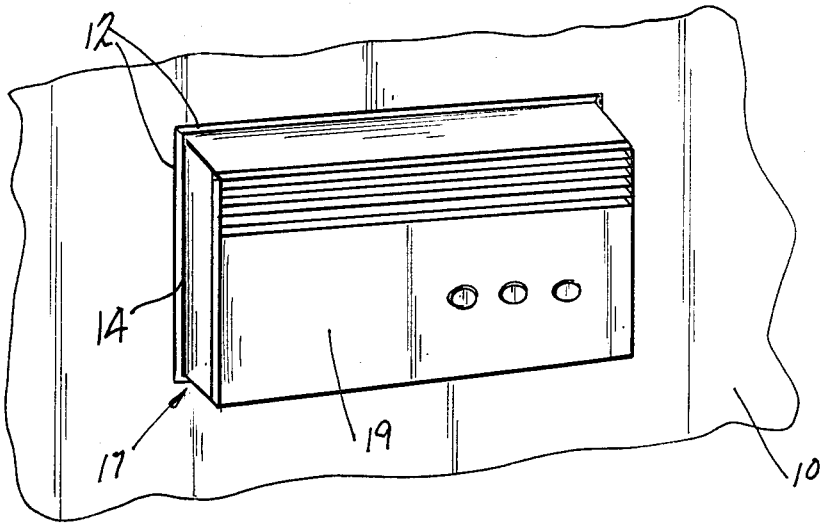
FIG. 1 is a schematic of an interior building wall with an air conditioning unit installed in a through wall opening.

Referring to FIG. 1, the pertinent elements of a typical through wall air conditioner are shown. The air conditioning unit 17 is shown installed into an interior building wall 10 through an opening in the wall. A space or gap 12 exists between the air conditioning unit and the wall. The front face or cover plate 19 of the air conditioner faces the interior of the room. The gap 12 between the appliance and the wall may include a built-in sleeve 14 for the appliance. Such sleeves generally have some insulation strips within the sleeve. This insulation usually is inadequate for preventing excessive heat loss and drafts during cold weather.

Figure 2:
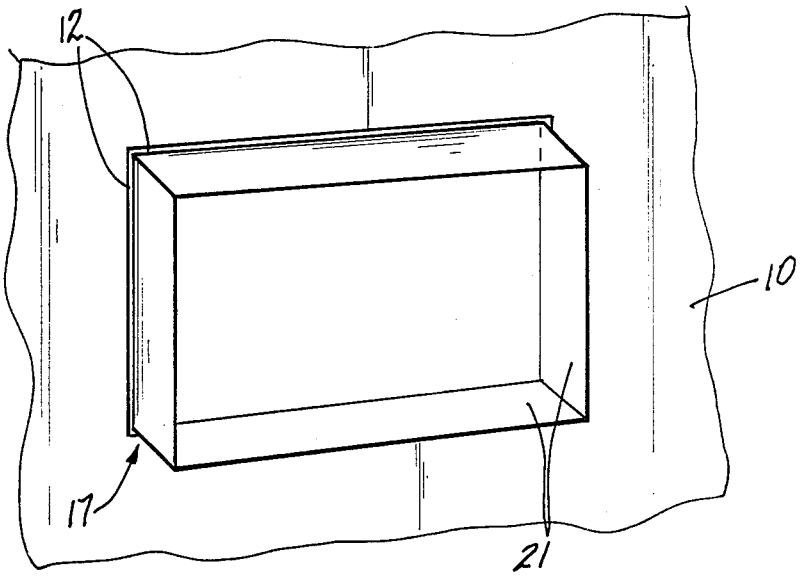
FIG. 2 is a schematic of the same unit as in FIG. 1 with the front face or cover plate removed.
Figure 3:
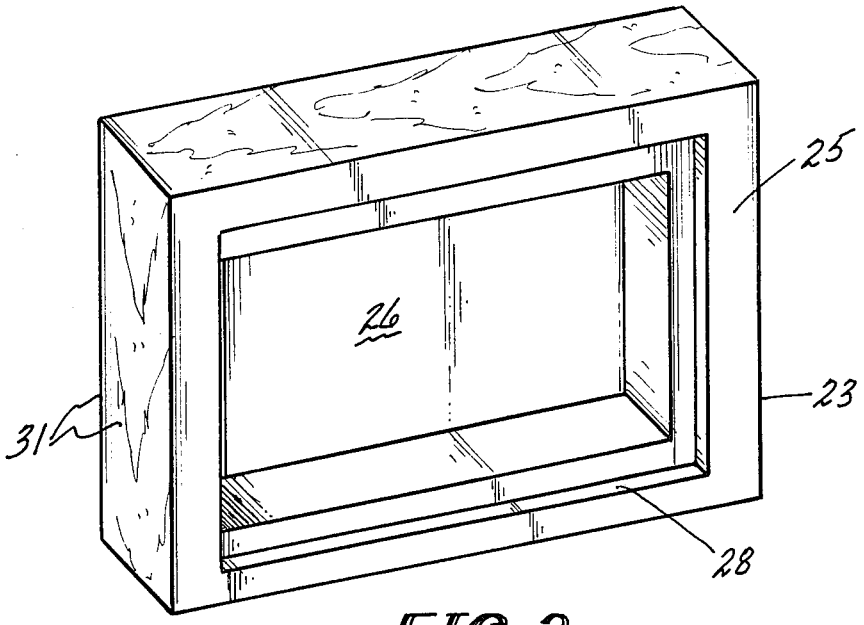
FIG. 3 is a schematic of the decorative insulating cover with the cut outs required for fitting over the air conditioning unit.

The air conditioning unit 17 is shown in FIG. 2 with the front face or cover plate 19 removed. The side walls 21 of the air conditioning unit extend into the room. The elements of the decorative insulating cover for in wall air conditioners and fans are shown schematically in FIG. 3. The insulating cover 23 consists of a one piece section of insulating material such as closed cell styrofoam, urethane foam, polyethylene foam or similar insulating materials. This single unit is then routed or otherwise modified to fit the air conditioning unit and wall sleeve. The insulating cover consists of an interior face 25 which fits against the interior wall 10. A groove or slot 28 is developed to match the outline of the air conditioning unit side walls 21 so that the insulating cover can slide over the side walls and wall sleeve in place of the normal operating cover. The development of said groove or slot allows this cover to be designed for any regular or irregular shaped opening. The center portion of the insulating cover is modified to permit full installation while retaining a solid back wall 26 of insulating material. The front and side walls of the insulating cover can then receive a decorating finish 31, as desired. The perspective view shown in FIG. 3 of the insulating cover is the portion of the cover facing outdoors. This section slides over the air conditioning unit and contacts the interior wall 10 with the cover face 25.

Figure 4:
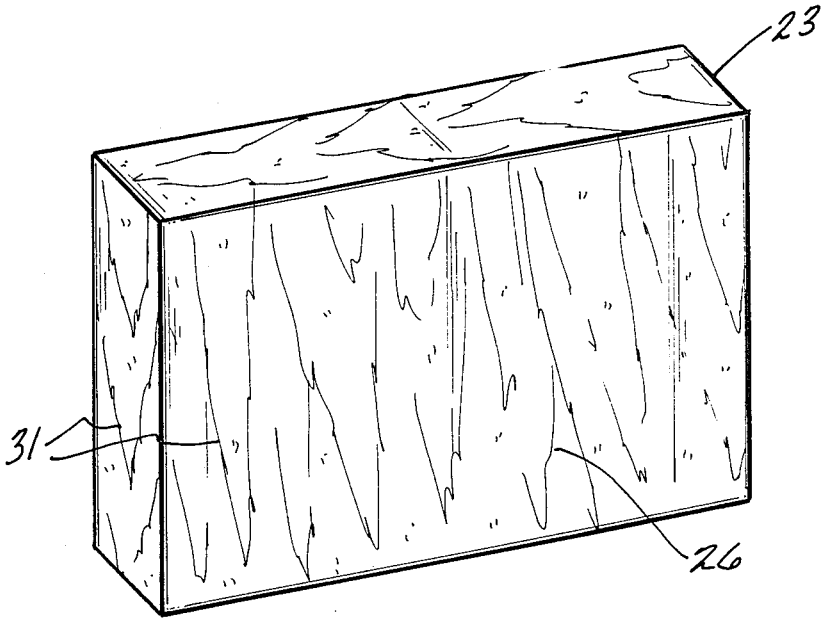
FIG. 4 is a schematic of the decorative insulating cover as it appears inside the room in which it is installed.

The opposite perspective view of the insulating cover 23 is shown in FIG. 4. The solid back wall 26 of the insulating cover is shown facing inward to the room and the decorating finish 31 is shown on all visible surfaces.

While the preferred embodiments have been described and illustrated, various modifications and substitutions may be made without departing from the scope of this invention. It is to be understood, therefore, that the present invention has been described by way of illustration and not limitation.

What is claimed is:

1. A decorative insulating cover for in wall air conditioners and appliances which comprises:

a one piece section of insulating material;

said section consisting of solid side and back walls;

said walls incorporating a grooved or slotted design which matches the appliance and wall sleeve to be covered;

said grooved or slotted design to be sized to permit sliding over said appliance;

said grooved or slotted design arranged to suit specific regular or irregular shapes;

said grooved or slotted design to incorporate an insulating face to fit against the building wall.

2. A device as recited in claim 1 wherein:

said insulating material is closed cell styrofoam, urethane foam, polyethylene foam or similar insulating material.

3. A device as recited in claim 2 wherein:

said solid side and back walls incorporate a decorative finish on all exposed surfaces.

* * * * *